US005750063A

United States Patent [19]

Hoyt

[11] Patent Number: 5,750,063

[45] Date of Patent: May 12, 1998

[54] PLATE-TYPE SHEATH/CORE-SWITCHING DEVICE AND METHOD OF USE

[75] Inventor: Matthew B. Hoyt, Arden, N.C.

[73] Assignee: BASF Corporation, Mt. Olive, N.J.

[21] Appl. No.: 872,130

[22] Filed: Jun. 10, 1997

Related U.S. Application Data

[63] Continuation-in-part of Ser. No. 623,125, Mar. 28, 1996, abandoned.

[51] Int. Cl.[6] ..... D01D 4/06; D01F 8/04

[52] U.S. Cl. ..... 264/172.15; 216/83; 425/463

[58] Field of Search ..... 264/172.15; 425/131.5, 425/463; 216/83

[56] References Cited

U.S. PATENT DOCUMENTS

| | | | |
|---|---|---|---|
| 3,787,162 | 1/1974 | Cheetham | 425/463 |
| 4,381,274 | 4/1983 | Kessler | 264/147 |
| 4,406,850 | 9/1983 | Hills | 264/169 |
| 4,445,833 | 5/1984 | Moriki et al. | 425/131.5 |
| 5,162,074 | 11/1992 | Hills | 216/83 |

*Primary Examiner*—Leo B. Tentoni

[57] ABSTRACT

A sheath/core-switching device contains a first plate(s) having a first flow path and a second plate(s) having a second flow path. The first flow path contains a first chamber, a first central-port, and multiple first channels with multiple first outer-ports radially disposed around the first central-port. The second flow path contains a second chamber, multiple second channels having multiple second outer-ports, and multiple third channels having multiple second central-ports which are radially disposed around the second central-ports. The sheath and core phases of a sheath/core fluid stream can be switched by means of the device by directing the stream axially to the first chamber where the stream is split into a core-stream and multiple sheath-substreams. The core-stream flows through the first central-port to the second chamber. The sheath-substreams flow through the first channels and first outer-ports to the third channels. In the second chamber, the core-stream splits into multiple core-substreams which flow through the second channels and second outer-ports. The sheath-substreams flow through the third channels and second central-ports. The core-substreams exiting the second outer-ports and the sheath-substreams exiting the second central-ports are disposed in a sheath/core configuration, the sheath-substreams forming the core and the core-substreams forming the sheath.

37 Claims, 1 Drawing Sheet

PLATE-TYPE SHEATH/CORE-SWITCHING DEVICE AND METHOD OF USE

This application is a continuation-in-part of application Ser. No. 08/623,125, filed on Mar. 28, 1996, now abandoned.

BACKGROUND OF THE INVENTION

This invention relates to a device and method for making sheath/core multicomponent fibers. More particularly, this invention relates to a device and method for switching sheath and core components in a sheath/core multicomponent fluid stream.

Sheath/core fibers are desirable because such fibers can offer a combination of properties not normally obtained from a monocomponent fiber. For example, sheath/core bicomponent fibers have been especially useful in applications requiring fibers which have both softness and mechanical strength properties. Fibers used in such applications typically contain a sheath component which provides the softness properties and a core component which provides the mechanical properties.

However, in the sheath/core fluid streams from which sheath/core fibers are formed, it sometimes occurs that the core component would be more useful in the sheath portion while the sheath component would be preferred in the core portion of the fiber. In such circumstances, it would be desirable from both a financial standpoint and a time-consumption standpoint to avoid making a new sheath/core fluid stream from scratch which has the desired sheath and core components disposed in the desired portions of the fiber. It would be desirable to provide a device and method of using same capable of switching the sheath and core components in an already-made sheath/core fluid stream.

It would be further desirable to provide a sheath/core-switching device which is relatively simple in structure and relatively inexpensive to make, clean, inspect, re-use and/or replace.

Plate-type flow distribution apparatuses used in the preparation of sheath/core bicomponent fibers are known in the art. Reference is made, e.g., to U.S. Pat. Nos. 5,162,074 to Hills; 4,445,833 to Moriki; and 4,381,274 to Kessler.

None of the foregoing references, however, teaches a flow distribution apparatus capable of switching the sheath and core components in a sheath/core fluid stream. In addition, many conventional flow-distribution apparatuses use thick metal plates. Thick plates tend to make devices containing them bulky and, therefore, more expensive to make, inspect, clean, re-use or replace. Such plates themselves are relatively expensive and must be accurately drilled, reamed or otherwise machined at considerable expense. In addition, with use, polymer material tends to solidify and collect in the distribution flow passages which must be periodically cleaned and then inspected to ensure that the cleaning process has effectively removed all of the collected material. The small size of the flow passages renders the inspection process tedious and time-consuming and, therefore, imparts a considerable cost to the overall cleaning/inspection process. The high initial cost of the distribution plates precludes discarding or disposing of the plates as an alternative to cleaning.

U.S. Pat. No. 5,162,074 to Hills teaches the use of thin plates in making fibers, including sheath/core bicomponent fibers. Structures composed of thin plates tend to be less bulky than those with thick plates, and are relatively easy and inexpensive to make, inspect, clean, re-use or replace.

Thus, it would be desirable to provide a sheath/core-switching device composed of relatively thin plates.

In addition, Hills teaches the use of etching to form channels and apertures in relatively thin plates, the apertures having an L/D ratio of no more than 1.50. According to Hills, etching, e.g., photochemical etching, provides precisely formed and densely packed passage configurations. Furthermore, etching is much less expensive than drilling, milling, reaming, or other machining/cutting processes used to form distribution flow paths in thick plates used in the prior art. Thus, it is further desirable to provide a sheath/core-switching device composed of relatively thin plates having etched channels and/or apertures formed therein.

Therefore, a primary object of this invention is to provide a plate-type sheath/core-switching device capable of switching the sheath and core components in an already-made sheath/core multicomponent fluid stream.

A further object of this invention is to provide a plate-type sheath/core-switching device which is not bulky and which is relatively less expensive to make, inspect, clean, re-use or replace.

Another object of this invention is to provide a plate-type sheath/core-switching device which can be composed of relatively thin plates.

A further object of this invention is to provide a plate-type sheath/core-switching device comprising channels and/or apertures which can be photochemically etched therein.

A still further object of this invention is to provide a method for switching sheath and core components in a sheath/core multicomponent fluid stream by means of a plate-type sheath/core-switching device having the characteristics set forth in the preceding objects.

These and other objects which are achieved according to the present invention can be readily discerned from the following description.

SUMMARY OF THE INVENTION

The present invention is directed to a sheath/core-switching device and a method of using same to switch sheath and core phases of an initial multicomponent sheath/core fluid stream composed of a core phase and a sheath phase.

The device of this invention contains:

at least one first plate having formed on a front face thereof at least one first flow path containing: a first chamber disposed to receive flow of the sheath/core multicomponent fluid stream in an axial direction so as to cause the fluid stream to split upon receipt thereof by the first chamber into a core-stream and multiple sheath-substreams, the core-stream containing the core phase of the stream and the sheath-substreams containing the sheath phase of the stream; a first central-port disposed in fluid communication with the first chamber, the first central-port being disposed to receive flow of the core-stream; multiple outwardly-extending first channels disposed downstream of and in fluid communication with the first chamber, the first channels being disposed to receive flow of the sheath-substreams; and multiple first outer-ports formed in downstream ends of the first channels and disposed to receive flow of the sheath-substreams, the first outer-ports being radially disposed around the first central-port; and at least one second plate having formed on a front face thereof at least one second flow path containing: a second chamber disposed downstream of and in fluid communication with the first central-port, the second chamber being disposed to receive flow of the core-stream in an axial direction so as to cause the core-stream to split upon receipt thereof by the second chamber into multiple core-substreams; multiple outwardly-extending second channels disposed downstream of and in fluid communication with the second chamber, the second channels being disposed to receive flow of the core-substreams; multiple second outer-ports disposed in downstream ends of the second channels, the second outer-ports being disposed to receive flow of the core-substreams; multiple inwardly-extending third channels disposed downstream of and in fluid communication with the first outer-ports, the third channels having inlet-ends disposed to receive flow of the sheath-substreams in an axial direction; and multiple second central-ports disposed in downstream ends of the third channels, the second central-ports being disposed to receive flow of the sheath-substreams, the second outer-ports being radially disposed around the second central-ports such that the core-substreams exiting the second outer-ports and the sheath-substreams exiting the second central-ports are mutually aligned in a sheath/core configuration such that the core of the configuration is composed of the sheath-substreams and the sheath of the configuration is composed of the core-substreams.

The present invention is further directed to a method of switching the sheath and core components of a sheath/core multicomponent fluid stream by means of the plate-type sheath/core-switching device of this invention.

The plate-type sheath/core-switching device of this invention is relatively simple in structure and inexpensive to make, inspect, clean, re-use and replace.

DETAILED DESCRIPTION OF THE INVENTION

Figure 1:
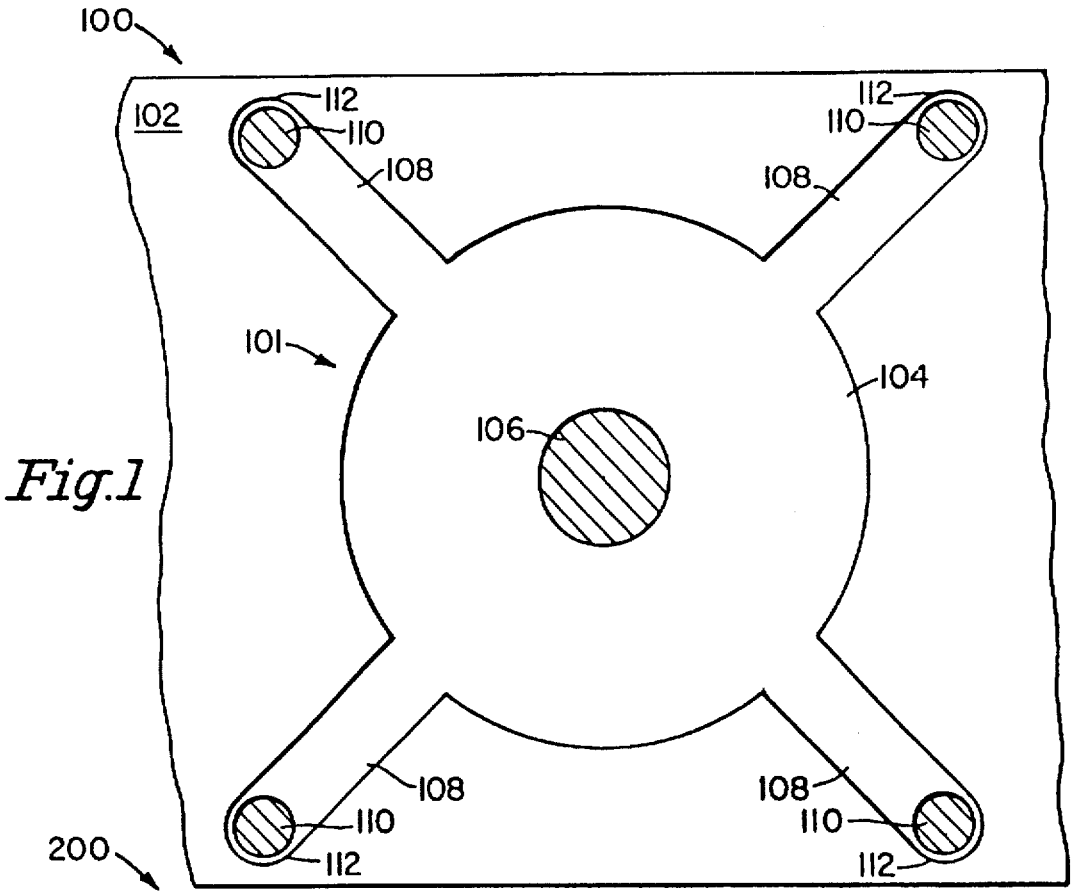
FIG. 1 represents an embodiment of the first plate useful in the sheath/core-switching device of the present invention.

The present invention provides a sheath/core-switching device and a method of using the device to switch the sheath and core phases of a sheath/core multicomponent fluid stream.

The device of this invention contains at least one first plate and at least one second plate. The first plate has formed on a front face thereof at least one first flow path and the second plate has formed on a front face thereof at least one second flow path.

The first flow path contains a first chamber, a first central-port, a plurality of outwardly-extending first channels, and a plurality of first outer-ports formed in downstream ends of the first channels and radially disposed around the first central-port. The first chamber is disposed to receive flow of the sheath/core multicomponent fluid stream in an axial direction so as to cause the fluid stream to split upon receipt thereof by the first chamber into a core-stream and multiple sheath-substreams. The core-stream contains the core phase of the fluid stream, and the sheath-substreams are composed of the sheath phase of the stream. The first central-port is disposed in fluid communication with the first chamber and, preferably, is formed in the first chamber. The first central-port is disposed to receive flow of the core-stream. The outwardly-extending first channels are disposed downstream of and in fluid communication with the first chamber and are disposed to receive flow of the sheath-substreams. The multiple first outer-ports, which are radially disposed around the first central-port, are formed in downstream ends of the first channels and are disposed to receive flow of the sheath-substreams. The term "outwardly-extending" with respect to the first channels in the first chamber means that the channels extend outwardly from the first chamber, as shown, for example, in FIG. 1 herein.

The second flow path contains a second chamber, a plurality of outwardly-extending second channels, and a plurality of second outer-ports formed in downstream ends of the second channels. In addition, the second flow path is composed of a plurality of inwardly-extending third channels and a plurality of second central-ports formed in downstream ends of the third channels. The second outer-ports are radially disposed around the second central-ports. The second chamber is disposed downstream of and in fluid communication with the first central-port of the first flow path. The second chamber is disposed to receive flow of the core-stream in an axial direction so as to cause the core-stream to split upon receipt thereof by the second chamber into multiple core-substreams. Preferably, the second chamber will be axially aligned with the first central-port in the first flow path. The outwardly-extending second channels are disposed downstream of and in fluid communication with the second chamber. The second channels are disposed to receive flow of the core-substreams. The inwardly-extending third channels are disposed downstream of and in fluid communication with the first outer-ports of the first flow path. The third channels have inlet-ends which are disposed to receive flow of the sheath-substreams in an axial direction. Preferably, the inlet-ends of the third channels are axially aligned with the first outer-ports of the first flow path. Formed in downstream ends of the third channels are the second central-ports which are disposed to receive flow of the sheath-substreams. Radially disposed around the second central-ports are the second outer-ports. The core-substreams exit through the second outer-ports and the sheath-substreams exit through the second central-ports such that the exiting core-substreams and the exiting sheath-substreams are mutually aligned in a sheath/core configuration such that the core of the configuration is composed of the sheath-substreams and the sheath of the configuration is composed of the core-substreams.

Preferably, the third channels in the second flow path and the first channels in the first flow path are mutually aligned in parallel fashion while the first and second channels are misaligned, in other words, the first and second channels are aligned in non-parallel fashion with respect to one another. Also preferably, the second channels and the third channels are arranged in alternating, adjacent fashion in the second flow path. This can be seen, for example, in FIGS. 1 and 2 herein.

Figure 2:
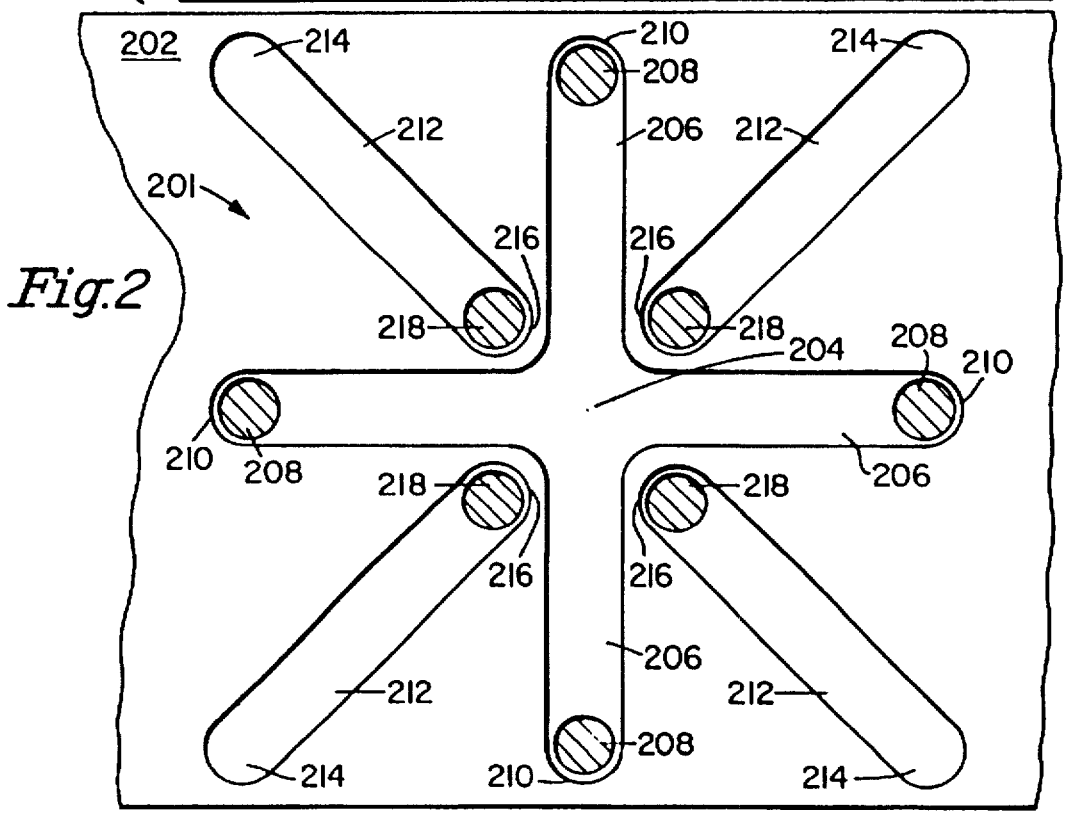
FIG. 2 represents an embodiment of the second plate useful in the sheath/core-switching device of the present invention.

The term "outwardly-extending" with respect to the second channels means that the channels extend outwardly from the second chamber, as shown, for example, in FIG. 2 herein. The term "inwardly-extending" with respect to the third channels means that the channels extend inwardly toward the second chamber, as shown, for example, in FIG. 2 herein.

The term "axial" as used in connection with the receipt of the sheath/core stream by the first chamber means a direction which is perpendicular or substantially perpendicular to the front face of the first plate. The term "axial" as used in connection with the receipt of the core-stream by the second chamber and the receipt of the sheath-substreams by the third channels means a direction which is perpendicular or substantially perpendicular to the front face of the second plate.

Preferably, in the device of this invention, the respective front faces of the first and second plates are disposed horizontally. Thus, an axial direction with respect to these front faces means a vertical direction.

In preferred embodiments of the device of this invention, the first channels are disposed at equal angles with respect to the first chamber, the second channels are disposed at equal angles with respect to the second chamber, and the third channels are disposed at equal angles with respect to the second chamber. More preferably, the first flow path contains at least four first channels, and the second flow path contains at least four second channels and at least four third channels, wherein each of the first channels forms a right angle with respect to an immediately preceding first channel and an immediately succeeding first channel; each of the second channels forms a right angle with respect to an immediately preceding second channel and an immediately succeeding second channel; and each of the third channels forms a right angle with respect to an immediately preceding third channel and an immediately succeeding third channel.

The device of this invention may contain the first and second plates disposed adjacent to one another in a stacked front-to-back facial configuration. Alternatively, the device of this invention may contain one or more intervening or spacer plates disposed between and in fluid communication with the first and second plates. Such an intervening or spacer plate or plates may be used so long as the requisite channels, chambers and ports in the first and second flow paths are disposed in fluid communication with one another in the manner described herein.

The device of this invention may be composed of one first plate and one second plate, or a plurality of each of the first and second plates, wherein the first plates are stacked together in an end-to-end or side-by-side configuration, and the second plates are stacked together in an end-to-end or side-by-side configuration.

In addition, the device of this invention may contain one first flow path and one second flow path. Alternatively, the device may contain a plurality of each of the first and second flow paths, wherein the first flow paths are disposed in an end-to-end or side-by-side stacked configuration, and the second flow paths are disposed in an end-to-end or side-by-side stacked configuration.

Preferably, the first and second plates, as well as any intervening or spacer plates used therewith, are thin, each having a thickness of preferably from about 0.001 inch to about 1.0 inch, more preferably from about 0.01 inch to about 0.25 inch, and most preferably from about 0.01 inch to about 0.10 inch.

The first chamber and the first channels each preferably have a depth of from about 10% to about 80%, more preferably from about 30% to about 70%, of the depth of the respective first and second plates. The second chamber and the second and third channels each preferably have a depth of from about 10% to about 80%, more preferably from about 30% to about 70%, of the depth of the second plate.

The first and second plates can be composed of metallic or non-metallic material. Suitable non-metals include, e.g., thermoplastic resins. Suitable metals include, e.g., stainless steel, aluminum, aluminum-based alloys, nickel, iron, copper, copper-based alloys, mild steel, brass, titanium and other micromachinable metals.

Although the first and second flow paths can be formed by any suitable micromachining process, the flow paths are preferably formed by a photochemical etching process, i.e., the flow paths are preferably photochemically-etched structures. Photochemical etching processes are well known in the art and are typically carried out by contacting a surface with a conventional etchant.

Non-limiting examples of other suitable micromachining processes include stamping, punching, pressing, cutting, molding, milling, lithographing, and particle blasting.

As mentioned previously herein, the present invention is further directed to a method of switching the sheath and core phases of a first sheath/core multicomponent fluid stream containing sheath and core phases. The method involves the steps of:

(1) providing the sheath/core-switching device of this invention;

(2) directing the stream into the first chamber in an axial direction, whereby the stream is split upon impact with the first chamber into the core-stream and the sheath-substreams;

(3) passing the core-stream through the first central-port and passing the sheath-substreams through the first channels and the first outer-ports;

(4) directing the core-stream into the second chamber in an axial direction, whereby the core-stream is split upon impact with the second chamber into the core-substreams;

(5) passing the core-substreams through the second channels and the second outer-ports; and (6) directing the sheath-substreams into the inlet-ends of the third channels; and (7) passing the sheath-substreams through the third channels and the second central-ports, whereby the core-substreams exiting the second outer-ports and the sheath-substreams exiting the second central-ports are mutually aligned in a sheath/core configuration wherein the core of the configuration contains the sheath-substreams and the sheath of the configuration contains the core-substreams.

After passage of the core-substreams through the second outer-ports and the sheath-substreams through the second central-ports, the core-substreams and the sheath-substreams can be recombined to form a second sheath/core multicomponent fluid stream having a core region composed of the sheath-substreams and a sheath region composed of the core-substreams.

The core-substreams and the sheath-substreams may be recombined by any known means for combining streams into a sheath/core configuration. Preferably, the substreams are recombined by means of a "distributor plate". Such plates are disclosed, e.g., in U.S. Pat. No. 5,162,074 (Hills), which has been previously incorporated by reference herein.

The distributor plate may be used alone or in conjunction with one or more spacer plates disposed between and in fluid communication with the second plate and the distributor. The spacer plate(s) preferably has a central-aperture formed therein (preferably by photochemical etching), wherein the central-aperture is axially aligned with the central-ports in the second plate to receive and conduct the sheath-substreams from the central-ports. The sheath-substreams are combined in the central-aperture to form a single sheath-stream. In addition, the spacer plate(s) preferably has outer-apertures formed therein (preferably by photochemical etching) which are axially aligned with the second outer-ports in the second plate to receive and conduct the core-substreams.

The distributor plate has one or more final distribution apertures formed therethrough (preferably by photochemical etching), each aperture being centered over a respective spinneret hole and under a respective central-port in the second plate or a central-aperture in the spacer plate(s). In addition, the distribution aperture(s) in the distributor plate is configured so as to register with respective second outer-ports in the second plate or outer-apertures in the spacer plate(s).

The shape of the distribution aperture(s) is not crucial. The aperture(s) can be a rounded square or rectangle, a rounded triangle, a circle, a star-shape, or substantially any shape. In particular, the final distribution aperture(s) can be any configuration which permits the sheath-substreams to be conducted in an axial direction therethrough and into a corresponding spinneret inlet hole, and which permits the core-substreams to be conducted inward toward the spinneret inlet hole for each of the second outer-ports in the second plate or in the spacer plate(s). Preferably, the periphery of the distribution aperture(s), regardless of the shape of the aperture(s), be tangential to the second outer-ports in order to effect smooth flow transition from an axial direction in the second outer-ports to a outer direction through the distribution aperture(s).

In preferred embodiments, the distribution aperture(s) in the distributor plate is star-shaped, wherein the aperture(s) is centered over a respective spinneret inlet hole and under the central-ports in the second plate or under the central-aperture in the spacer plate(s). The legs of the star-shaped aperture(s) extend radially outward to register with respective second outer-ports in the second plate or outer-apertures in the spacer plate(s). The extremity of each star leg is preferably rounded to match the contour of its corresponding aligned second outer-port or outer-aperture.

The distribution aperture(s) directs the core-substreams radially inwardly toward the corresponding spinneret inlet hole to provide a uniform layer of the core-substreams around the sheath-stream to form a second sheath/core multicomponent fluid stream, which is then issued axially to the spinneret inlet hole. The second sheath/core multicomponent fluid stream may then undergo spinning by conventional spinning methods to form sheath/core multicomponent fibers. Suitable sheath/core fiber-spinning processes are disclosed, e.g., in U.S. Pat. No. 5,162,074, which has been previously incorporated by reference herein.

A variety of materials can be used to form the sheath/core multicomponent fluid streams used in the present invention. Preferably, the materials are thermoplastic polymers such as, for example, polyolefins, e.g., polypropylene, high density polyethylene (HDPE) and the like; polyamides, e.g., nylon 6, nylon 12 and the like; and polyesters, e.g. polyethylene terephthalate (PET).

A particular suitable sheath/core bicomponent fluid stream for use in this invention contains nylon 6 and HDPE. More preferably, the first sheath/core bicomponent fluid stream (i.e., the stream in which the sheath and core components are to be switched in accordance with this invention) is composed of nylon 6 as the sheath component and HDPE as the core component. Accordingly, the preferred second sheath/core multicomponent fluid stream will be composed of HDPE as the sheath component and nylon 6 as the core component.

Other particular polymer mixtures which can be used in the sheath/core fluid streams used in the present invention include, for example, polycaproamide/polyethylene terephthalate, polycaproamide/polypropylene, polyethylene terephthalate/polyethylene and polyethylene terephthalate/polypropylene mixtures.

The core:sheath volume ratio in the fluid streams used in this invention preferably ranges from about 80:20 to about 20:80; more preferably ranges from about 40:60 to about 60:40, and most preferably is about 50:50.

The sheath/core multicomponent fluid streams used in the present invention can be formed by any conventional method used to form such streams. For example, the stream may be formed by any of the methods described in U.S. Pat. Nos. 4,406,850 (Hills); 3,787,162 (Cheetham); 4,445,833 (Moriki et al.); 4,381,274 (Kessler et al.); and 5,162,074 (Hills); each of the foregoing references being incorporated by reference in its entirety.

In one particularly preferred method for forming sheath/core multicomponent fluid streams, a liquid mixture composed of at least two immiscible thermoplastic polymer components having different melt viscosity values are passed through a shear zone at a shear rate and a shear temperature sufficient to separate the melt viscosity-differing polymer components into substantially discrete and continuous phases. The formation of the phases is the result of the shearing action, which generally causes one polymer component to move away from the central region of the shear zone and the other polymer component to move toward the central region of the shear zone. The final product will be a multicomponent fluid stream containing the polymer components in a sheath/core configuration.

The second sheath/core multicomponent fluid stream may undergo spinning by any conventional means to form a sheath/core multicomponent fiber.

The sheath/core-switching device and method of this invention will now be described with reference to FIGS. 1 and 2 herein.

FIGS. 1 and 2 represent respective first and second plates which can be used in the device of this invention.

In FIG. 1, first plate 100 has a front or upstream face 102 on which is formed a first flow path 101. Flow path 101 is composed of a first chamber 104 having a first central-port 106 formed therein. Disposed in fluid communication with chamber 104 are a plurality of outwardly-extending first channels 108, each having a first outer-port 110 formed in a downstream end 112 thereof. As can be seen in FIG. 1, first outer-ports 110 are radially disposed around first central-port 106. In addition, in FIG. 1, first channels 108 are preferably disposed at equal angles with respect to first chamber 104, each of channels 108 being disposed at a 90° angle with respect to immediately preceding and succeeding channels 108.

In FIG. 2, second plate 200 has a front or upstream face 202 on which is formed a second flow path 201. Second flow path 201 is composed of a second chamber 204 and a plurality of outwardly-extending second channels 206 disposed in fluid communication with chamber 204. Channels 206 each have a second outer-port 208 formed in a downstream end 210 thereof. Also formed on upstream face 202 are a plurality of inwardly-extending third channels 212, each having an inlet-end 214 and a downstream-end 216. Formed in each downstream-end 216 is a second central-port 218. As shown in FIG. 2, second outer-ports 208 are radially disposed around second central-ports 218. As can also be seen in FIG. 2, second channels 206 are preferably disposed at equal angles with respect to chamber 204, each channel 206 forming a right angle with immediately preceding and succeeding channels 206. In addition, as shown in FIG. 2, third channels 212 are also preferably disposed at equal angles with respect to chamber 204, with each channel 212 forming a right angle with immediately succeeding and preceding channels 212.

In preferred embodiments of the device of this invention, second chamber 204 is axially aligned with first central-port 106, while inlet-ends 214 are axially aligned with first outer-ports 110.

Referring to FIGS. 1 and 2, the method of this invention involves directing a first sheath/core multicomponent fluid stream (not shown) through an inlet means (not shown) to the first chamber 104. Central-chamber 104 receives the stream in an axial direction, i.e., a direction which is perpendicular to respective faces 102 and 202. The stream is split in chamber 104 into a core-stream (not shown) and a plurality of sheath-substreams (not shown). The core-stream flows through first central-port 106 to second chamber 204. The sheath-substreams flow through first channels 108 to first outer-ports 110. The sheath-substreams pass through outer-ports 110 to inlet-ends 214 of third channels 212.

The core-stream is received by second chamber 204 in an axial direction and is split into a plurality of core-substreams (not shown). The core-substreams flow through second channels 206 to second outer-ports 208. The sheath-substreams flow through third channels 212 to second central-ports 218 in downstream ends 216 of outer-channels 212. The core-substreams flow through outer-ports 208 and the sheath-substreams flow through second central-ports 218. The resulting core-substream output streams (not shown) and sheath-substream output streams (not shown) can then be recombined to form a second sheath/core multicomponent fluid stream (not shown) having a core region composed of the sheath-substream output streams and a sheath region composed of the core-substream output streams.

Although the present invention has been described with reference to preferred embodiments, those skilled in the art will recognize that changes may be made in form and detail without departing from the spirit and scope of the invention.

What is claimed is:

1. A sheath/core-switching device for switching sheath and core phases of an initial multicomponent sheath/core fluid stream comprising a core phase and a sheath phase, said device comprising:

at least one first plate having formed on a front face thereof at least one first flow path comprising: a first chamber disposed to receive flow of said sheath/core multicomponent fluid stream in an axial direction so as to cause said fluid stream to split upon receipt thereof by said first chamber into a core-stream and multiple sheath-substreams, said core-stream comprising said core phase of said stream and said sheath-substreams comprising said sheath phase of said stream; a first central-port disposed in fluid communication with said first chamber, said first central-port being disposed to receive flow of the core-stream; multiple outwardly-extending first channels disposed downstream of and in fluid communication with said first chamber, said first channels being disposed to receive flow of the sheath-substreams; and multiple first outer-ports formed in downstream ends of the first channels and disposed to receive flow of said sheath-substreams, the first outer-ports being radially disposed around the first central-port; and at least one second plate having formed on a front face thereof at least one second flow path comprising: a second chamber disposed downstream of and in fluid communication with said first central-port, said second chamber being disposed to receive flow of the core-stream in an axial direction so as to cause said core-stream to split upon receipt thereof by said second chamber into multiple core-substreams; multiple outwardly-extending second channels disposed downstream of and in fluid communication with said second chamber, said second channels being disposed to receive flow of the core-substreams; multiple second outer-ports disposed in downstream ends of said second channels, said second outer-ports being disposed to receive flow of the core-substreams; multiple inwardly-extending third channels disposed downstream of and in fluid communication with said first outer-ports, the third channels having inlet-ends disposed to receive flow of the sheath-substreams in an axial direction; and multiple second central-ports disposed in downstream ends of said third channels, said second central-ports being disposed to receive flow of the sheath-substreams, the second outer-ports being radially disposed around the second central-ports such that said core-substreams exiting said second outer-ports and said sheath-substreams exiting said second central-ports are mutually aligned in a sheath/core configuration such that the core of said configuration comprises said sheath-substreams and said sheath of said configuration comprises said core-substreams.

2. A device according to claim 1, wherein the first central-port is formed in the first chamber.

3. A device according to claim 1, wherein the first channels are disposed at equal angles with respect to the first chamber, the second channels are disposed at equal angles with respect to the second chamber, and the third channels are disposed at equal angles with respect to the second chamber.

4. A device according to claim 1, wherein the first flow path comprises at least four of the first channels, and the second flow path comprises at least four of the second channels and at least four of the third channels.

5. A device according to claim 4, wherein each of the first channels forms a right angle with respect to an immediately preceding first channel and an immediately succeeding first channel; each of the second channels forms a right angle with respect to an immediately preceding second channel and an immediately succeeding second channel; and each of the third channels forms a right angle with respect to an immediately preceding third channel and an immediately succeeding third channel.

6. A device according to claim 5, wherein the first channels and the third channels are mutually aligned in parallel fashion while the first and second channels are aligned in non-parallel fashion with respect to each other.

7. A device according to claim 1, wherein the second-chamber is axially aligned with the first central-port and the inlet-ends of the third channels are axially aligned with the first outer-ports.

8. A device according to claim 1, wherein the second channels and the third channels are arranged in alternating, adjacent fashion.

9. A device according to claim 1, wherein the first and second plates are adjacent to one another in a stacked front-to-back facial configuration.

10. A device according to claim 1, wherein the device comprises one first plate and one second plate.

11. A device according to claim 1, wherein the front face of the first plate and the front face of the second plate are disposed horizontally.

12. A device according to claim 1, wherein the device comprises a plurality of first plates and a plurality of second plates, wherein the first plates are stacked together in an end-to-end or side-by-side configuration, further wherein the second plates are stacked together in an end-to-end or side-by-side configuration.

13. A device according to claim 1, wherein the first plate comprises one first flow path and the second plate comprises one second flow path.

14. A device according to claim 1, wherein the first plate comprises a plurality of first flow paths disposed in an end-to-end or side-by-side stacked configuration, further wherein the second plate comprises a plurality of second flow paths disposed in an end-to-end or side-by-side stacked configuration.

15. A device according to claim 1, wherein each of the first and second plates has a thickness of from about 0.001 inch to about 1.0 inch.

16. A device according to claim 15, wherein the thickness ranges from about 0.01 inch to about 0.25 inch.

17. A device according to claim 1, wherein the first and second flow paths are photochemically etched structures.

18. A device according to claim 1, wherein the first chamber and the first channels have a depth equal to about 10% to about 80% of a thickness of the first plate, and the second chamber and the second and third channels have a depth equal to about 10% to about 80% of a thickness of the second plate.

19. A method for switching sheath and core phases in a first sheath/core multicomponent fluid stream comprising a sheath phase and a core phase comprising the steps of:

(1) providing a sheath/core-switching device comprising:

at least one first plate having formed on a front face thereof at least one first flow path comprising: a first chamber disposed to receive flow of said sheath/core multicomponent fluid stream in an axial direction so as to cause said fluid stream to split upon receipt thereof by said first chamber into a core-stream and multiple sheath-substreams, said core-stream comprising said core phase of said stream and said sheath-substreams comprising said sheath phase of said stream; a first central-port disposed in fluid communication with said first chamber, said first central-port being disposed to receive flow of the core-stream; multiple outwardly-extending first channels disposed downstream of and in fluid communication with said first chamber, said first channels being disposed to receive flow of the sheath-substreams; and multiple first outer-ports formed in downstream ends of the first channels and disposed to receive flow of said sheath-substreams, the first outer-ports being radially disposed around the first central-port; and at least one second plate having formed on a front face thereof at least one second flow path comprising: a second chamber disposed downstream of and in fluid communication with said first central-port, said second chamber being disposed to receive flow of the core-stream in an axial direction so as to cause said core-stream to split upon receipt thereof by said second chamber into multiple core-substreams; multiple outwardly-extending second channels disposed downstream of and in fluid communication with said second chamber, said second channels being disposed to receive flow of the core-substreams; multiple second outer-ports disposed in downstream ends of said second channels, said second outer-ports being disposed to receive flow of the core-substreams; multiple inwardly-extending third channels disposed downstream of and in fluid communication with said first outer-ports, the third channels having inlet-ends disposed to receive flow of the sheath-substreams in an axial direction; and multiple second central-ports disposed in downstream ends of said third channels, said second central-ports being disposed to receive flow of the sheath-substreams, the second outer-ports being radially disposed around the second central-ports such that said core-substreams exiting said second outer-ports and said sheath-substreams exiting said second central-ports are mutually aligned in a sheath/core configuration such that the core of said configuration comprises said sheath-substreams and said sheath of said configuration comprises said core-substreams;

(2) directing the stream into the first chamber in the axial direction, whereby the stream is split upon impact with the first chamber into the core-stream and the sheath-substreams;

(3) passing the core-stream through the first central-port and passing the sheath-substreams through the first channels and the first outer-ports;

(4) directing the core-stream into the second chamber in the axial direction, whereby the core-stream is split upon impact with the second chamber into the core-substreams;

(5) passing the core-substreams through the second channels and the second outer-ports; and (6) directing the sheath-substreams into the inlet-ends of the third channels;

(7) passing the sheath-substreams through the third channels and the second central-ports, whereby said core-substreams exiting said second outer-ports and said sheath-substreams exiting said second central-ports are mutually aligned in said sheath/core configuration wherein the core of said configuration comprises said sheath-substreams and said sheath of said configuration comprises said core-substreams.

20. A method according to claim 19, further comprising recombining the sheath-substreams and the core-substreams to form a second sheath/core multicomponent fluid stream having a core region and a sheath region, wherein the core region comprises the sheath-substreams and the sheath region comprises the core-substreams.

21. A method according to claim 19, wherein the first central-port is formed in the first chamber.

22. A method according to claim 19, wherein the first channels are disposed at equal angles with respect to the first chamber, the second channels are disposed at equal angles with respect to the second chamber, and the third channels are disposed at equal angles with respect to the second chamber.

23. A method according to claim 19, wherein the first flow path comprises at least four of the first channels, and the second flow path comprises at least four of the second channels and at least four of the third channels.

24. A method according to claim 23, wherein each of the first channels forms a right angle with respect to an immediately preceding first channel and an immediately succeeding first channel; each of the second channels forms a right angle with respect to an immediately preceding second channel and an immediately succeeding second channel; and each of the third channels forms a right angle with respect to an immediately preceding third channel and an immediately succeeding third channel.

25. A method according to claim 24, wherein the first channels and the third channels are mutually aligned in parallel fashion while the first and second channels are aligned in non-parallel fashion with respect to each other.

26. A method according to claim 19, wherein the second chamber is axially aligned with the first central-port and the inlet-ends of the third channels are axially aligned with the first outer-ports.

27. A method according to claim 19, wherein the second channels and the third channels are arranged in alternating, adjacent fashion.

28. A method according to claim 19, wherein the first and second plates are adjacent to one another in a stacked front-to-back facial configuration.

29. A method according to claim 19, wherein the device comprises one first plate and one second plate.

30. A method according to claim 19, wherein the front face of the first plate and the front face of the second plate are disposed horizontally.

31. A method according to claim 19, wherein the device comprises a plurality of first plates and a plurality of second plates, wherein the first plates are stacked together in an end-to-end or side-by-side configuration, further wherein the second plates are stacked together in an end-to-end or side-by-side configuration.

32. A method according to claim 19, wherein the first plate comprises one first flow path and the second plate comprises one second flow path.

33. A method according to claim 19, wherein the first plate comprises a plurality of first flow paths disposed in an end-to-end or side-by-side stacked configuration, further wherein the second plate comprises a plurality of second flow paths disposed in an end-to-end or side-by-side stacked configuration.

34. A method according to claim 19, wherein each of the first and second plates has a thickness of from about 0.001 inch to about 1.0 inch.

35. A method according to claim 19, wherein the first and second flow paths are formed by a photochemical etching process.

36. A method according to claim 19, wherein the first plate comprises one of the at least one first flow path and the second plate comprises one of the at least one second flow path.

37. A method according to claim 19, wherein the first plate comprises a plurality of the at least one first flow path and the second plate comprises a plurality of the at least one second flow path.

* * * * *